United States Patent [19]

Ollinger et al.

[11] Patent Number: 4,730,433

[45] Date of Patent: Mar. 15, 1988

[54] END DETAIL FOR CEILING RUNNER

[75] Inventors: James C. Ollinger, Lancaster; Daniel C. Ziegler, Millersville, both of Pa.

[73] Assignee: Armstrong World Industries, Inc., Lancaster, Pa.

[21] Appl. No.: 946,717

[22] Filed: Dec. 29, 1986

[51] Int. Cl.[4] ..... E04C 3/32

[52] U.S. Cl. ..... 52/735

[58] Field of Search ..... 52/664–667, 52/484, 735; 403/347, 348

[56] References Cited

U.S. PATENT DOCUMENTS

| | | | |
|---|---|---|---|
| 3,142,367 | 7/1964 | Brown et al. | 52/484 |
| 3,396,997 | 8/1968 | Adams | 52/484 |
| 3,979,874 | 9/1976 | Cubbler et al. | 52/664 |
| 4,525,973 | 7/1985 | Vukmanic et al. | 52/484 |
| 4,549,383 | 10/1985 | Vukmanic et al. | 403/347 |

*Primary Examiner*—James L. Ridgill, Jr.

[57] ABSTRACT

An end detail for a ceiling runner is provided incorporating a tongue extending from the end of the ceiling runner with a tab formed as part of the tongue. Due to the construction of the ceiling runner, the tab is formed from two side-by-side pieces of metal which tend to separate. A means is provided near the base of the tab on the tongue for displacing a portion of the metal of the tongue laterally within the plane of the tongue to lock together the two pieces of metal forming the tongue.

3 Claims, 4 Drawing Figures

END DETAIL FOR CEILING RUNNER

BACKGROUND OF THE INVENTION

The invention is directed to an end detail for a ceiling runner, and, more particularly, to a means for preventing the separation of the metal forming the tongue of the end detail of the ceiling runner.

DESCRIPTION OF THE PRIOR ART

Reissue U.S. Pat. No. 31,201 discloses a ceiling board supporting grid system having a runner with vertical webs, horizontal flanges and a tongue structure. The tongue is provided with upper and lower stop shoulders for engaging one side of the web of a second runner and a resiliently yieldable finger extending outwardly at an angle from the tongue engages the opposite side of the same web. The runner is thus held in position perpendicular to a second runner.

SUMMARY OF THE INVENTION

A special end detail structure is provided for a ceiling runner. The ceiling runner has a vertical web and two horizontal flanges. Extending from the vertical web in the plane of the vertical web and beyond the end of the horizontal flanges there is provided a tongue. A tab is formed as part of the tongue and has an end extending out at an acute angle from the plane of the tongue. A projection forming a contact edge or stop shoulder is also provided in the plane of the tongue. The runner is inserted into a slot of another runner positioned at a right angle to the first runner and the projection engages one side of the vertical web of the second runner and the end of the tab engages the other side of the vertical web of the second runner to hold the two runners in engagement. A means is positioned near the base of the tab displacing a portion of the tongue metal laterally within the plane of the tongue. The tongue is formed from two side-by-side pieces of metal and the displacing of a portion of the tongue laterally behind the tab base will lock together the two pieces of metal so that they will not separate.

DESCRIPTION OF THE PREFERRED EMBODIMENTS

Figure 1:
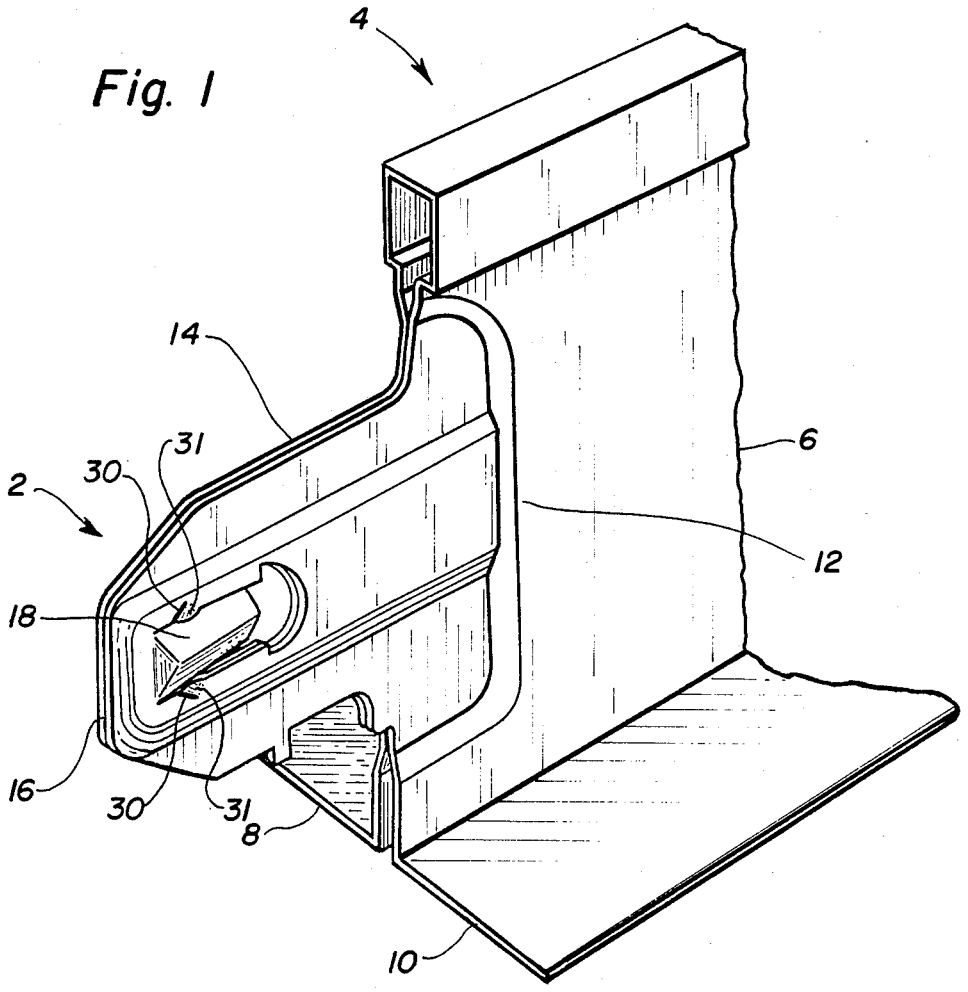
FIG. 1 is a perspective view of the end detail.

Referring now to FIG. 1, an end detail 2 for a ceiling runner 4 is shown wherein the ceiling runner has a vertical web 6 with two horizontal flanges 8 and 10 oppositely disposed on either side of the vertical web at the base of the vertical web. The vertical web is formed from two pieces of sheet metal being in an abuting side-by-side relationship. This occurs because a single piece of sheet metal is used to form the ceiling runner. One end of the sheet metal forms horizontal flange 8. It is then bent up to form one of the two side-by-side pieces forming the vertical web. It is then bent around into the top configuration of the runner which is shown as generally rectangular in shape. The sheet metal then comes back down the vertical web forming the second of the side-by-side pieces of metal and finally it bent out to form flange 10 and this is the opposite end of the sheet metal. Consequently, it can be seen that a single piece of sheet metal is bent to form the runner and the vertical web is formed with two side-by-side pieces of sheet metal.

At one end 12 of the vertical web, there extends integral with the vertical web, a tongue 14 in the plane of the vertical web. The tongue has a height less then the height of the vertical web. As can be seen in FIG. 1, the base of the tongue is above the horizontal flanges. The top of the tongue is below the top of the vertical web. The tongue does extend beyond the ends of the horizontal flanges. The tongue, at its terminal end 16, is formed with a tapered end.

Figure 2:
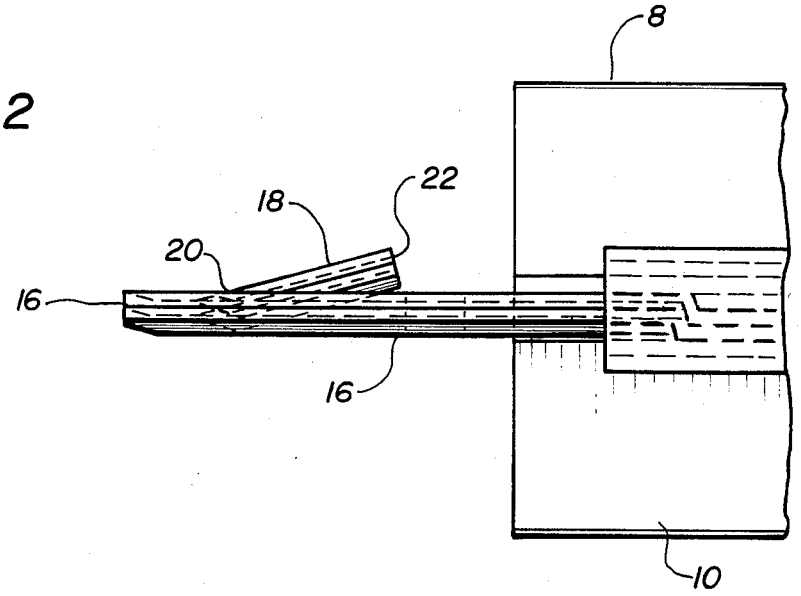
FIG. 2 is a top view of the end detail.

A tab 18 extends from the tongue. The tab has a base 20, a resilient end 22 and two sides. The tab is cut in part from the two pieces of sheet metal forming the tongue. The base 20 of the tab is uncut from the tongue but the two sides and end are cut from the tongue. The uncut base of the tab is positioned near the terminal end 16 of the tongue. The tab, due to having two sides and an end cut from the metal of the tongue, may be bent outward from the plane of the tongue so that it projects at an acute angle to the plane of the tongue as best seen in FIG. 2. The tab faces in the direction away from the terminal end of the tongue and the resilient end 22 of the tab has a straight edge 24.

The tongue has a projection 26 extending therefrom in the plane of the tongue. The projection is positioned near the point where the tongue is integral with the vertical web. The projection has a contact edge 28 which extends perpendicular to the plane of the horizontal flanges. The contact edge 28 is parallel and spaced from the straight terminal edge 24 of the tab.

In use, the tongue would be inserted in a slot in the manner generally shown in the above-mentioned reissue pattern. The second runner having the slot will be perpendicular to the plane of the vertical web of the first runner having the tongue. The spacing between contact edge 28 and straight edge 22 is approximately equal to the thickness of the vertical web of the second runner. In the invention herein the article is made with very close tolerances so that the contact edge 28 and straight terminal 24 will snuggly hold therebetween the vertical web of the second runner and, therefore, hold the first runner perpendicular to the second runner. The two runners are assembled by having the runner with the tongue inserted straight into and perpendicular to the plane of the vertical web of the second runner.

Figure 3:
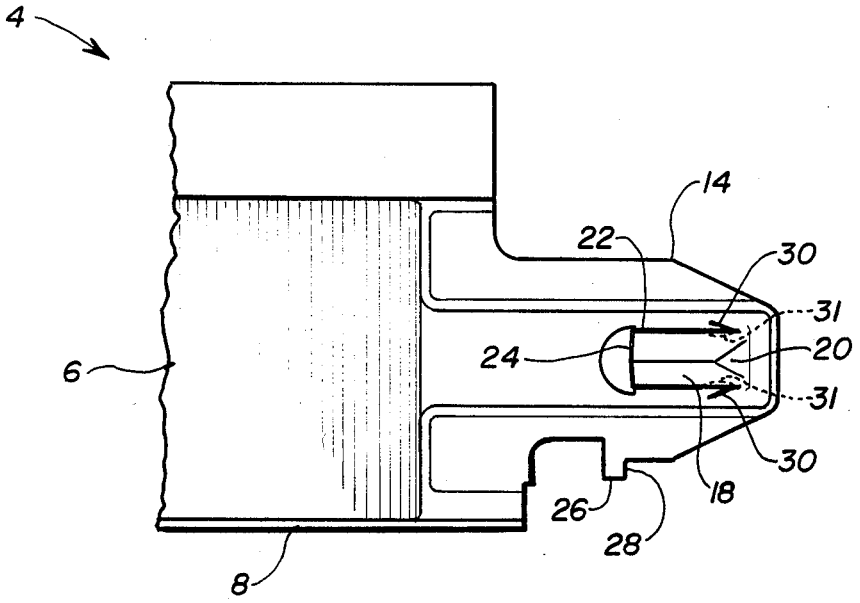
FIG. 3 is a side view of one embodiment of the invention.
Figure 4:
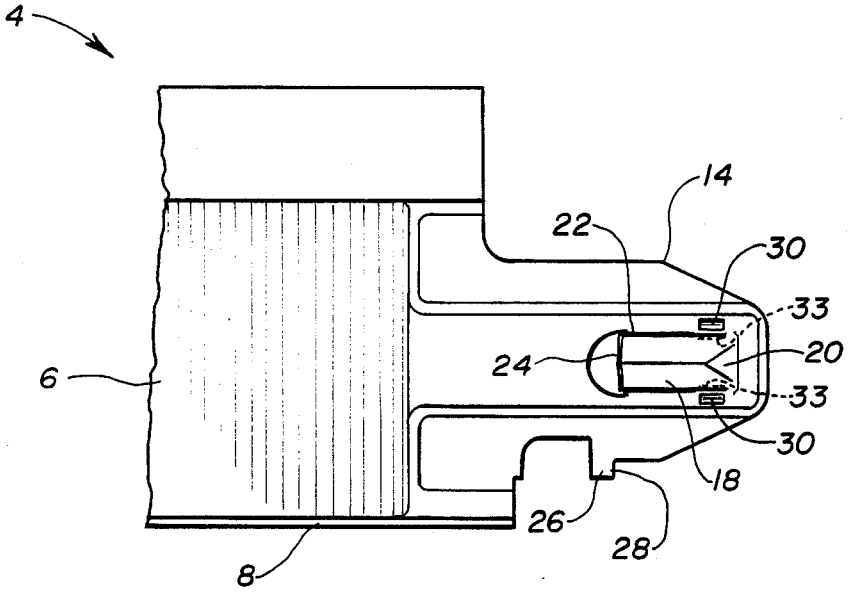
FIG. 4 is a side view of another embodiment of the invention.

The primary invention herein is shown in FIGS. 3 and 4. A means 30 is positioned near the base of the tab displacing a portion of the tongue metal laterally within the plane of the tongue. The displacing of the metal laterally behind the tab near its base locks together the two pieces forming the tongue. The separation of the metal forming the tongue makes it difficult to place two runners in a single slot of a third runner with the two runners extending into the slot from opposite sides thereof. The width of the slot is such that there is room for the terminal ends of the tongue and separation of the metal at the terminal ends of the tongue create a width for the tongue that is difficult to permit two tongues to be inserted into opposite sides of the slot.

FIG. 3 shows one embodiment of the means 30 wherein the element 30 is a cut or slot in the metal of the tongue extending from the base of the tab at an acute angle to the side of the tab. A cut 30 is placed on one or both sides of the tab, near the base of the tab, and is sufficient merely to displace a portion 31 of one side of the cut laterally behind the tab base and this will lock together the two pieces of metal forming the tongue.

FIG. 4 is another embodiment of the invention wherein the means 30 are one or more small, rectangular indentations placed in the tongue near the base of the tab and the indentations displace a portion 33 of the metal forming the tongue laterally within the plane of the tongue and behind the tab base and this in turn locks together the two pieces of metal forming the tongue. The indentation may be circular, spherical, or multi-sided shapes, which shapes are broadly considered polygonal.

Consequently, by both embodiments shown, the displacing of a portion of the metal of the tongue near the base of the tab locks the two side-by-side pieces of metal of the tongue together at the base of the tab and this, in turn, prevents the two pieces of metal forming the tongue from separating primarily at the end of the tongue construction.

What is claimed is:

1. An end detail for a ceiling runner wherein the ceiling runner has a vertical web with two horizontal flanges oppositely displaced on either side of the vertical web at the base of the vertical web, said vertical web being formed from two pieces of sheet metal being in an abutting side-by-side relationship, from at least one end of the vertical web there extends integral with the vertical web a tongue in the plane of the vertical web, but with a height less than the height of the vertical web, said tongue being spaced above the horizontal flanges and extends beyond the ends of the horizontal flanges, said tongue at its terminal end being formed with a tapered end, a tab extending from the tongue, said tab having a base, a resilient end and two sides, the tab being cut in part from the two pieces of sheet metal forming the tongue, the base of the tab being uncut from the tongue and being positioned near the terminal end of the tongue, the resilient end and two sides of the tab being cut from the tongue whereby the resilient end can project at an acute angle to the plane of the tongue in the direction away from the terminal end of the tongue, said resilient end having a straight terminal edge, and the tongue having a projection extending therefrom in the plane of the tongue, said projection being positioned near the point where the tongue is integral with the vertical web, said projection having a contact edge extending perpendicular to the plane of the horizontal flanges and being parallel to and spaced from the straight terminal edge of the resilient end of the tab, the improvement comprising:

(a) a means positioned near the base of the tab displacing a portion of the tongue metal laterally within the plane of the tonge behind the tab near its base whereby the displaced metal laterally behind the tab locks the two metal pieces of the tongue together.

2. An end detail for a ceiling runner as set forth in claim 1 wherein there is at least one slot cut in the tongue of the ceiling runner, the slot extends from the base of the tab at an acute angle to the sides of the tab in a direction away from the terminal end of the tongue, by starting with the cuts in the tongue near the point where the tab is still joined to the tongue, and at an angle away from the tab into the tongue structure there is caused a displacement laterally of a portion of the two side-by-side pieces of metal forming the tongue so that the metal on the side of the slot nearest the tab is displaced laterally behind the base of the tab and this locks together the two pieces of metal forming the tongue.

3. An end detail for a ceiling runner as set forth in claim 1 wherein polygonal-shaped indentations are placed in the structure of the tongue adjacent at least one side of the base of the tab where the tab is an integral part of the tongue, the indentations displace the metal of the tongue so that the metal in the indentation is displaced laterally within the plane of metal of the tongue and slightly behind the base of the tab and this displacement of the metal locks together the two pieces of metal forming the tongue so that they will not separate.

* * * * *